United States Patent [19]

Koizumi

[11] Patent Number: 4,751,549

[45] Date of Patent: Jun. 14, 1988

[54] COLOR COPYING MACHINE

[75] Inventor: Yutaka Koizumi, Yokohama, Japan

[73] Assignee: Ricoh Company, Ltd., Tokyo, Japan

[21] Appl. No.: 943,483

[22] Filed: Dec. 19, 1986

[30] Foreign Application Priority Data

Dec. 28, 1985 [JP] Japan ..... 60-299084

[51] Int. Cl.[4] ..... G03G 15/01

[52] U.S. Cl. ..... 355/4; 355/3 BE

[58] Field of Search ..... 355/3 BE, 4

[56] References Cited

U.S. PATENT DOCUMENTS

| | | | |
|---|---|---|---|
| 3,574,456 | 4/1971 | Grace | 355/4 |
| 3,627,410 | 12/1971 | Jugle | 355/4 |
| 3,694,069 | 9/1972 | Yamaji et al. | 355/4 |
| 3,724,943 | 4/1973 | Dravgelis et al. | 355/4 |
| 3,730,708 | 5/1973 | Jugle | 355/4 |
| 3,779,639 | 12/1973 | Tamai | 355/4 |
| 3,797,930 | 3/1974 | Tanaka et al. | 355/4 |
| 3,804,511 | 4/1974 | Rait et al. | 355/4 |
| 3,848,989 | 11/1974 | Yamaji et al. | 355/4 |
| 3,972,608 | 8/1976 | Moriyama et al. | 355/4 |
| 3,981,576 | 9/1976 | Inoue | 355/4 |
| 4,095,888 | 6/1978 | Kawazu et al. | 355/4 |
| 4,188,110 | 2/1980 | Stange | 355/4 |
| 4,472,047 | 9/1984 | Stoudt | 355/4 |
| 4,477,176 | 10/1984 | Russel | 355/4 |
| 4,518,246 | 5/1985 | Spitzner et al. | 355/4 |
| 4,660,077 | 4/1987 | Kawamura et al. | 355/4 |
| 4,662,739 | 5/1987 | Sakai et al. | 355/4 |
| 4,664,501 | 5/1987 | Koizumi et al. | 355/4 |
| 4,674,861 | 6/1987 | Kawamura | 355/4 |
| 4,690,542 | 9/1987 | Furuta et al. | 355/4 |

*Primary Examiner*—Patrick R. Salce
*Assistant Examiner*—Jeffrey Starrett
*Attorney, Agent, or Firm*—Oblon, Fisher, Spivak, McClelland & Maier

[57] ABSTRACT

A full-color copying machine copying color originals in colors as they are. A full-color copying machine in which a photosensitive member carrying multi-colored visible images obtained based on a color original is formed into belt, and the photosensitive belt is looped over between copying process stations.

7 Claims, 3 Drawing Sheets

COLOR COPYING MACHINE

FIELD OF THE INVENTION

This invention relates to a color copying machine, particularly to a full color copying machine which copies color originals in the same color as they are.

RELATED ART STATEMENT

Heretofore there has been known a full color copying machine which forms visible images of a variety of colors such as yellow (Y), magenta (M) and cyan (C) on a plurality of photosensitive drums, and superimposedly transfers these visible images one by one to a sheet of transfer printing material such as transfer printing paper to obtain a full color image.

According to the prior art, since the photosensitive members are formed into a drum shape, it has such a variety of disadvantages as follows: (1) Its copy processing speed is slow, because whole image exposure such as flash exposure cannot be applied thereto. (2) It cannot secure adequate space for the developing device and other devices, to be provided around the photosensitive member, because the devices take up too much room, thus necessitating special designs of external shapes of such devices to meet spacial requisites. (3) It must use a large-sized transfer drum to transfer a maximum size of transfer printing sheets, resulting in a slow copying speed when small-sized sheets are being copied. (4) It is not suitable for copying cardboard or small-sized sheets, because transfer printing sheets must be folded around a transfer drum and are clamped.

OBJECT AND SUMMARY OF THE INVENTION

In view of the above described drawbacks of the prior art, the first object of the invention is to provide a color copying machine which permits flash exposure. The second object is to provide a color copying machine which increases the design flexibility of devices which are to be disposed around a photosensitive member. The third object is to provide a color copying machine which can copy cardboard or other hard-to-bend transfer printing sheets as well. The fourth object is to provide a color copying machine which can color copy large-sized as well as small-sized originals at high speed.

The above first, second and third objects can be accomplished by forming a photosensitive member into belt shape and by generating space necessary for a variety of copying process stations (such as developing station, a transfer station) with the photosensitive belt moved.

The above fourth object is accomplished by changing loop lengths between transfer printing positions of the photosensitive belt.

BRIEF DESCRIPTION OF THE DRAWINGS

In the accompanying drawings, there are shown illustrative embodiments of the invention from which these and other of its objectives, novel features and advantages will be readily apparent.

In the drawings.

DETAILED DESCRIPTION OF PREFERRED EMBODIMENTS

Figure 1:
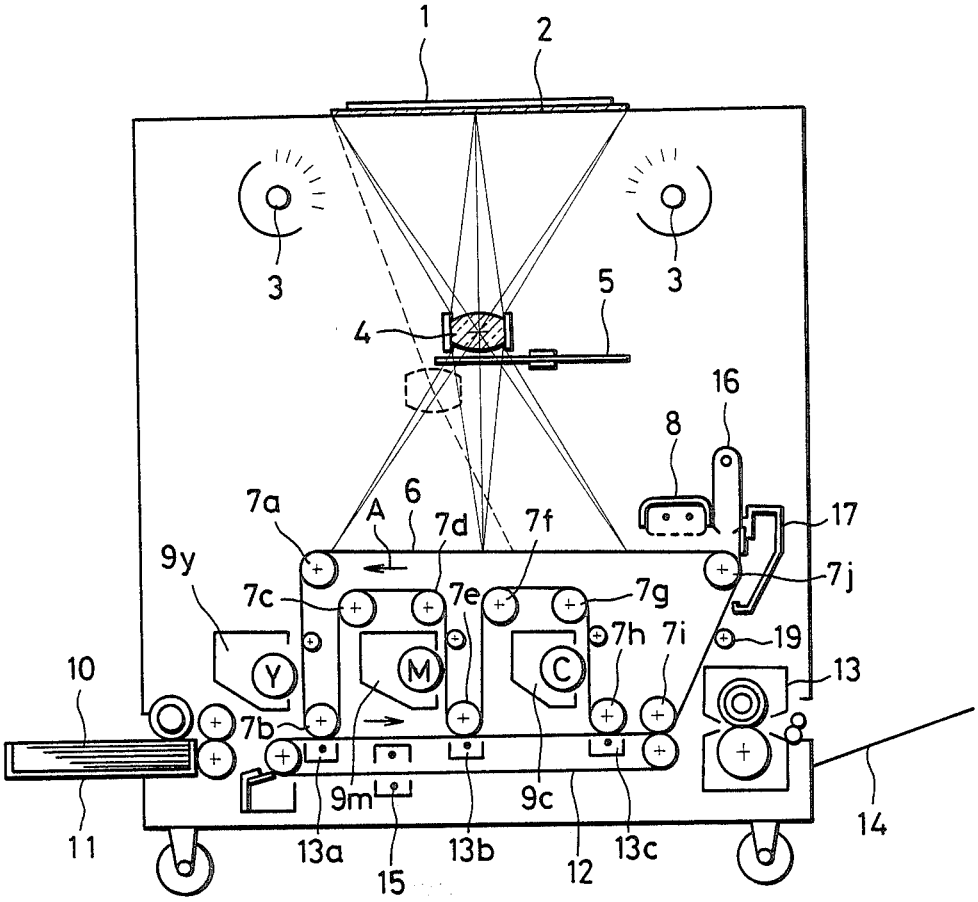
FIG. 1 is a side sectional view of an embodiment according to the invention.

In FIG. 1, Numeral 1 is an original which has color image and is going to be copied. The original 1 is placed on a contact glass 2 with a surface of the original 1 to be copied directed downwardly. Under the contact glass 2 are disposed flash exposure lamps 3 and 3, by which the whole sheet of the original 1 is illuminated at once. And, at the same time, reflected light beams irradiate a photosensitive belt 6 through a lens 4 and a filter 5. The belt, photosensitive member 6 is made of, for instance, an organic photo conductor having a seam. And, the photosensitive belt 6 is looped over a plurality of rollers *7a* to *7j* (in this case 10 rollers as shown in FIG. 1) to form a path of movement. Those rollers are arranged so that portions of the photosensitive belt 6, from *7b* to *7e* and *7e* to *7h* form a concave shape, viewed from under, as shown in FIG. 1. Any one of these rollers *7a* to *7j* functions as a drive roller, which circumferentially moves the photosensitive belt 6 along a path in direction of Arrow A in FIG. 1.

Figure 2:
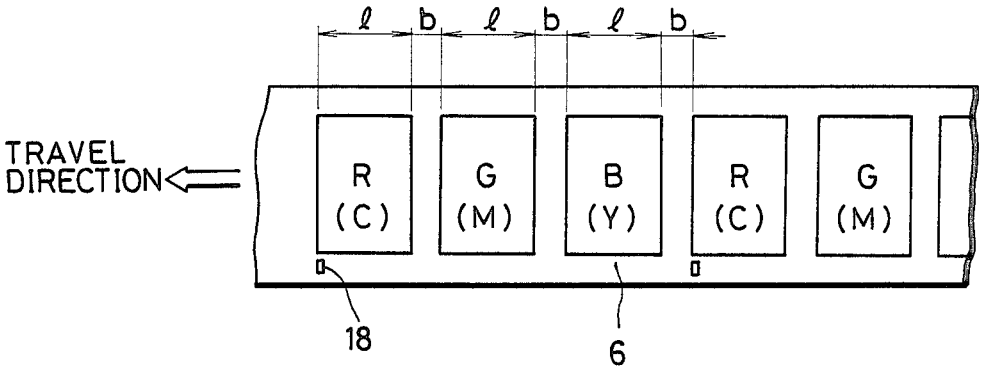
FIG. 2 is a schematic view showing images formed on a photosensitive belt.

First, the circumferentially rotating photosensitive belt 6 is uniformly charged by an electro static charger 8 over a whole surface thereof. Second, the flash exposure lamps 3 and 3 flash at least three times per a sheet of original 1 at given intervals. At the instant of every flash, colors of the filter 5 are changed in turn, for example, first red, second green and third blue and so on. Therefore, on the photosensitive belt 6 charged as described above and circumferentially rotating, as shown in FIG. 2, sequentially and with given spacings "b" formed are a latent image R (red filter image) for a light image, resolved by a red filter, of the images of the original 1, a latent image G (green filter image) for a light image resolved by a green filter, and a latent image B (blue filter image) for a light image resolved by a blue filter. A length "l" in FIG. 2 is an illumination region irradiated by the lamps 3 and 3, in other words, a size of original 1. These lengths l and b are determined based on instructions of a pulse encoder or the like (not shown) which synchronizes with a travel system of the photosensitive belt 6.

On a left side of the photosensitive belt 6, is disposed a yellow developing device *9y* containing yellow developer in complementary relation with blue color. And, in a concave portion formed by rollers *7b* to *7e* disposed as a magenta developing device *9m* containing magenta developer in complementary relation with green color, and in a concave portion formed by rollers *7e* to *7h* disposed is a cyan developing device *9c* containing cyan developer in complementary relation with red color.

Every electro static color latent image R, G and B on the photosensitive belt 6 is developed by a respective one of developing devices *9c*, *9m* and *9y*, and changed into a visible image. The photosensitive belt 6 is separated from the developing devices *9y*, *9m* and *9c*, or even if not separated, a bias voltage is so applied to as not to develop undesired visible images. The developing operation is timed as follows: An R image formed on the photosensitive belt 6 by a first light exposure is not developed by a developing device until it reaches the cyan developing device 9*c*. From now on, this image is called "C image". And, a G image formed on the photosensitive belt 6 by a second light exposure is not developed by a developing device until it reaches the magenta developing device 9*m*. This image is called "M image". A "B" image formed on the photosensitive belt 6 by a third light exposure is developed by the yellow developing device 9*y*. This image is called "Y image".

On the other hand, a transfer printing material for a color image to be transferred, for instance, a transfer printing sheet of paper 10 is fed out one by one from a paper feed tray 11, and then carried by a transfer belt 12, a transfer printing material carrier, toward a right side of the drawing. At this time, the transfer printing sheet 10 comes to a transfer station where it is in contact with or in close proximity to the photosensitive belt 6 at the rollers 7*b*, 7*e* and 7*h* (which are aligned in a plane) in turn, and each time visible images are transfer-printed superimposedly under the action of respective transfer charges 13*a*, 13*b* and 13*c* as transfer printing means. In this case, since Y image is formed by the yellow developing device 9*y* located on a left side, M image is formed by the magenta developing device 9*m* located at the center and C image is formed by the cyan developing device 9*c* located on the right side, visible images are superimposed in an order of Y image, M image and C image on the transfer printing paper 10 which is carried from left to right. Then, the transfer printing paper is separated from the transfer belt 12 at a right end thereof by a centrifugal force of curvature, and further discharged out into a tray 14 through a fixing device 13, when a color copy image is obtained by combination of Y, M and C images.

Figure 3:
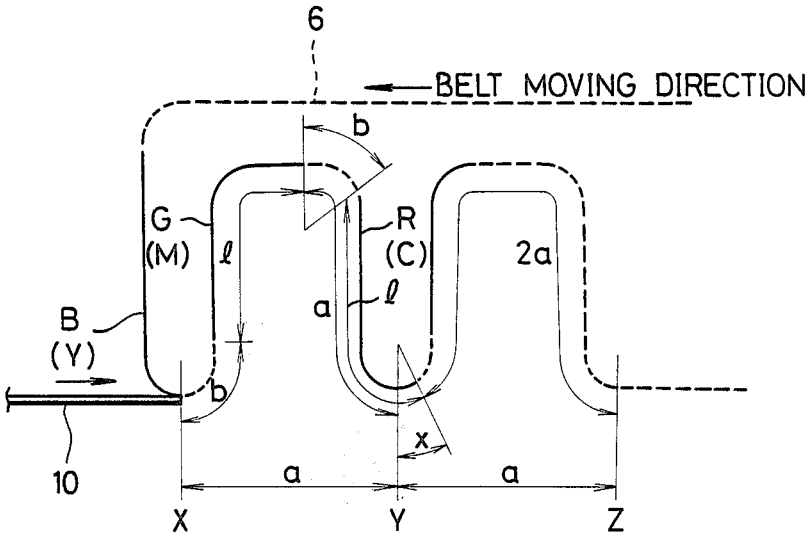
FIG. 3 is a schematic view showing a relationship between transfer positional intervals and photosensitive loop length.

The relationship between transfer stations of the Y, M and C images, i.e., positions where transfer printing chargers 13*a*, 13*b* and 13*c* are located, and loop lengths between transfer printing positions on the photosensitive belt 6 is as follows:

In FIG. 3, a first transfer station where Y image is transfer-printed is referred to as X, a second transfer station where M image is transfer-printed is referred to as Y, and a third-transfer station where C image is transfer-printed is referred to as Z. Now consider a case where $\overline{XY}=\overline{XZ}=a$, and an end of Y image and a leading edge of a transfer printing paper 10 happens to coexist at X. Since an end of M image must come to transfer station Y which is distance "a" apart from X when the leading edge of the transfer printing paper 10 reaches transfer station Y, as clearly shown in FIG. 3, a loop length of $\overset{\frown}{XY}$ must be (b+1+a) (lengths of b and 1 are the same as those in FIG. 2). And, if an end of C image is distance "x" apart from Y when the end of transfer station Y image and the leading edge of the transfer printing paper 10 happens to coexist, a loop length $\overset{\frown}{YZ}$ to a next transfer station Z becomes (2a+x), where, since x=1+b−a, loop length $\overset{\frown}{YZ}$ becomes (b+1+a) as well. Therefore, loop lengths $\overset{\frown}{XY}$ and $\overset{\frown}{YZ}$ of the photosensitive belt 6 ought to be equal to (b+1+a).

In this embodiment, polyester may be used as material for a transfer belt 12 of an order of 75u in thickness, monocomponent dry-type developing devices using nonmagnetic toner for developing devices 9*y*, 9*m* and 9*c*, an ac double corona charger for a charge removing device 15 for the transfer belt 12, a red LED for a quenching light source 16 and a rubber blade for a cleaning device 17.

Since the seam of the transfer belt 12 is not harmful to forming images, the length of the belt 12 is not limited to a particular length. On the other hand, concerning the seam of the photosensitive belt 6, regions of the belt 6 where images are to be formed must be kept out of the seam. In other words, an overall length of the photosensitive belt 6 must be n times a length required when an image for a maximum original size is formed (where n is an integer). And, further, timing marks 18 shown in FIG. 2 ought to be attached in order not to form images on the seam.

As described above, length and shape, necessary for each process station of the developing devices 9*y*, 9*m* and 9*c* etc., are formed by looping the photosensitive belt 6, thus realizing a belt-shaped photosensitive conductor.

Furthermore, transfer printing sheets of paper 10 can be carried substantially on a flat plane by the transfer belt 12, resulting in an easy copying of cardboard or small-sized originals.

Figure 4:
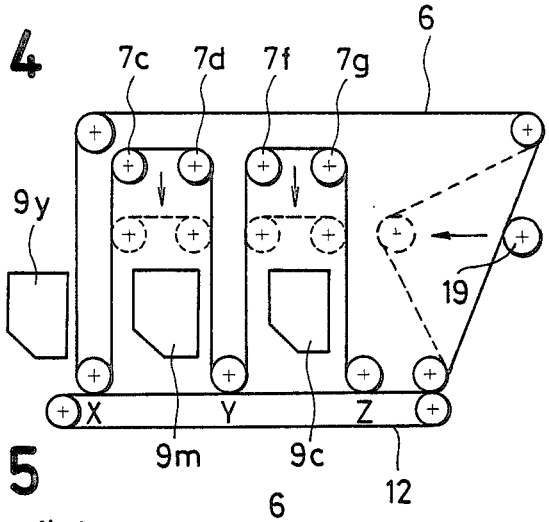
FIG. 4 is a side view showing main parts of another embodiment.

FIG. 4 shows main parts of another embodiment, in which four rollers 7*c*, 7*d*, 7*f* and 7*g* of the rollers looped over with a photosensitive belt 6 can shift to between positions shown by solid and broken lines, and a tension roller 19 is provided to keep a tension of the photosensitive belt 6 tight.

Figure 5:
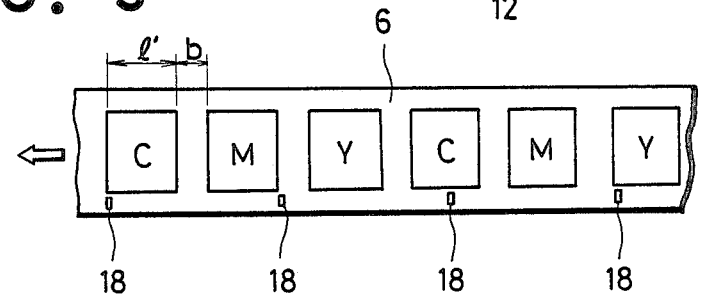
FIG. 5 is a schematic view showing image function on a photosensitive belt in the embodiment in FIG. 4.

When rollers 7*c*, 7*d*, 7*f* and 7*g* shift to the broken line positions, extended loop lengths $\overset{\frown}{XY}$ and $\overset{\frown}{YZ}$ of concave portions of the photosensitive belt 6 become shorter. This provides a smaller size 1' of image plane (FIG. 5) than 1 (FIG. 2), when originals of a small size are copied or reduction in size is required in copying. As a result, copying can be speeded up in comparison with a case when originals of normal size are copied as shown in FIG. 2.

Figure 6:
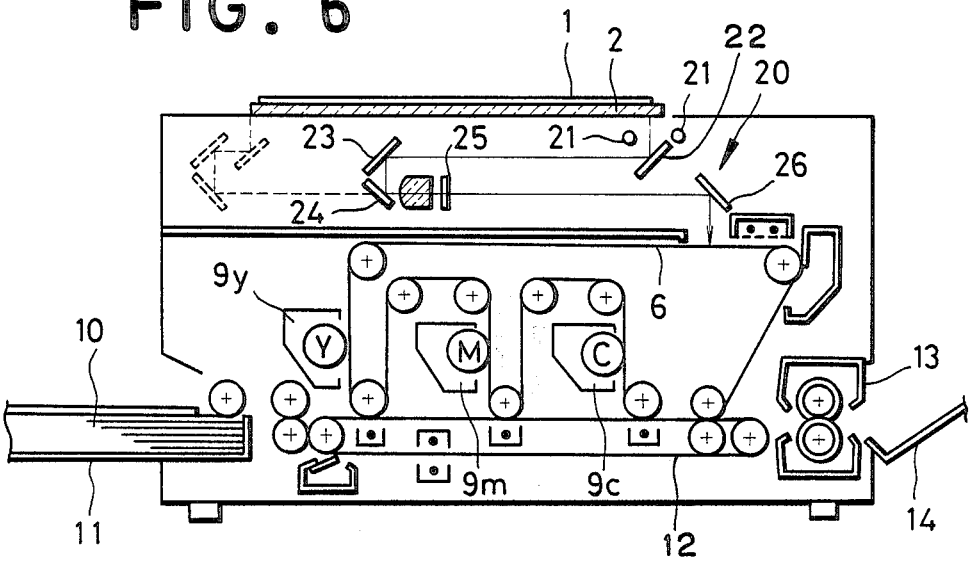
FIG. 6 is a side sectional view showing a further separate embodiment.

In addition, in the embodiment shown in FIG. 1 a visible image forming means consists of a light exposure system including an electro static charger 8 and flash light exposure lamps 3 and 3, and developing devices 9*y*, 9*m* and 9*c*, but any other configuration than this can be employed. For example, a so-called slit-type light exposure device 20 may be used, for a whole image flash exposure type, as shown in FIG. 6, where the same parts as used in FIG. 1 have the same numerals as given in FIG. 1. The slit-type exposure device 20 has lamps 21 moving below a contact glass 2, mirrors 22, 23 and 24 moving in a similar way, a lens 25 and another mirror 26 to slit-expose light images from an original 1 on a photosensitive belt 6.

What is claimed is:

1. A color copying machine comprising:

a photosensitive belt movable along a path;

latent image forming means for sequentially forming a plurality of adjacent partial color latent images;

separate developing means for each of said partial color latent images and disposed along said path, each of said developing means including means for developing a corresponding one of said partial color latent images to form a partial color visible image;

a plurality of image transfer stations, one of said stations being defined along said path for each of said partial color visible images and being positioned downstream of a corresponding one of said means for developing said partial color latent images in a moving direction of said belt;

transfer printing material carrying means for sequentially moving a sheet of transfer printing material through each of said image transfer stations; and transfer printing means disposed at each of said image transfer stages for transferring one of said partial color visible images into a sheet of transfer printing material carried by said transfer printing material carrying means, whereby said partial color visible images are superimposed on said sheet of transfer printing material to form a color image.

2. A color copying machine as claimed in claim 1, including means for changing a loop length of the photosensitive belt between two image transfer stations placed one after another to match the size of an original.

3. A color copying machine as claimed in claim 1, including means for changing a loop length of the photosensitive belt between two image transfer stations placed one after another to match the length of the partial-color visible image.

4. A color copying machine as claimed in claim 1, wherein a loop length of said photosensitive belt between two image transfer stations placed one after another amounts to (b+l+a), b being a distance between the two partial-color visible images, l a length of the partial-color visible image and a being a length of a transport path of said transfer printing material between said two image transfer stages placed one after another.

5. A color copying machine as claimed in claim 1, wherein said image transfer stations are aligned substantially on a flat plane, and said transfer printing material carrying means carries the sheet of transfer printing material substantially on a flat plane.

6. A color copying machine as claimed in claim 5, wherein said transfer printing material carrying means comprises a transfer belt looped over a plurality of rollers.

7. A color copying machine as claimed in claim 5, wherein said path forms concavities between said transfer stations and at least one of said developing means is positioned in said concavities.

* * * * *